US008526664B2

(12) United States Patent
Akino

(10) Patent No.: US 8,526,664 B2
(45) Date of Patent: Sep. 3, 2013

(54) CAPACITOR MICROPHONE UNIT AND CAPACITOR MICROPHONE

(75) Inventor: Hiroshi Akino, Tokyo (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 235 days.

(21) Appl. No.: 12/949,111

(22) Filed: Nov. 18, 2010

(65) Prior Publication Data

US 2011/0142265 A1 Jun. 16, 2011

(30) Foreign Application Priority Data

Dec. 16, 2009 (JP) ..... 2009-284784

(51) Int. Cl.
*H04R 1/00* (2006.01)
*H04R 11/02* (2006.01)

(52) U.S. Cl.
USPC ..... 381/426; 381/423

(58) Field of Classification Search
USPC ..... 381/174, 179, 337, 345, 346, 426, 381/423, 424
See application file for complete search history.

(56) References Cited

U.S. PATENT DOCUMENTS

| | | | | |
|---|---|---|---|---|
| 3,816,672 | A * | 6/1974 | Gefvert et al. | 381/352 |
| 5,764,595 | A * | 6/1998 | Power | 367/103 |
| 2004/0125975 | A1* | 7/2004 | Suzuki et al. | 381/369 |
| 2006/0222196 | A1* | 10/2006 | Uchimura | 381/356 |

FOREIGN PATENT DOCUMENTS

| | | | |
|---|---|---|---|
| JP | 04293398 | A * | 10/1992 |
| JP | 7-29996 | | 6/1995 |
| JP | 07029996 | U * | 6/1995 |
| JP | 2008118260 | A * | 5/2008 |
| JP | 2009-200869 | A * | 9/2009 |

* cited by examiner

*Primary Examiner* — Fan Tsang
*Assistant Examiner* — Eugene Zhao
(74) *Attorney, Agent, or Firm* — Whitham Curtis Christofferson & Cook, PC

(57) ABSTRACT

The present invention relates to a capacitor microphone unit including a diaphragm, a fixed electrode that is arranged opposite to the diaphragm with a space provided between the diaphragm and the fixed electrode so that a capacitor is formed between the diaphragm and the fixed electrode, an insulating base that is disposed on a rear side of the fixed electrode and supports the fixed electrode, and a ring-shaped acoustic resistance material that is disposed on a front side of the insulating base, all of which are incorporated in a unit casing. A skin layer is formed on at least one of a front side and a rear side of the acoustic resistance material, and the skin layer has a higher density than that inside the acoustic resistance material, whereby acoustic resistance can be readily controlled.

9 Claims, 7 Drawing Sheets

CAPACITOR MICROPHONE UNIT AND CAPACITOR MICROPHONE

BACKGROUND OF THE INVENTION

1. Field of the Invention

The present invention relates to a capacitor microphone unit and a capacitor microphone of which acoustic resistance can be readily controlled.

2. Description of the Related Art

Capacitor microphones include a capacitor microphone unit in which a diaphragm that vibrates upon receiving sound waves and a fixed electrode (also referred to as a "back electrode") are placed opposite to each other with a spacer provided therebetween to form a capacitor. Capacitance of the capacitor changes when the diaphragm vibrates. Such a capacitor microphone unit is built inside a unit casing.

In such a capacitor microphone unit, acoustic resistance is provided to limit or control sound waves guided to the diaphragm to obtain a desired directionality. For example, acoustic resistance is provided by providing an acoustic resistance material that covers a sound communication hole on an insulating base as described in Japanese Utility Model Laid-open No. H07-29996.

The basic structure of a capacitor microphone unit that is incorporated in a capacitor microphone and includes an acoustic resistance material is as illustrated in FIGS. 6 and 7. In the capacitor microphone unit 1 as illustrated in FIG. 6, sound waves entering a rear acoustic terminal A pass through an air chamber provided with an acoustic resistance material 18 formed of a sponge or the like and a second acoustic resistance material 17 formed of a nylon mesh or the like to be applied to the rear side of the diaphragm. Thus, the capacitor microphone unit 1 has unidirectionality.

In FIG. 6, the capacitor microphone unit 1 is formed by installing the elements described below inside a unit casing 11 having a cylindrical shape. A side on which a bottom 11*a* is provided is the front side of the unit casing 11. The bottom 11*a* is provided with multiple holes 22 through which sound is guided, inside the capacitor microphone unit 1. A ring-shaped diaphragm holder 12 and a diaphragm 13 having the peripheral portion attached to one end surface of the diaphragm holder 12 are disposed at the position closest to the bottom 11*a* in the unit casing 11.

A fixed electrode 15 is arranged opposite to the diaphragm 13 with a ring-shaped spacer 14 provided therebetween. Naturally, a space defined by the thickness of the spacer 14 is provided between the fixed electrode 15 and the diaphragm 13. Thus, a capacitor is formed by the fixed electrode 15 and the diaphragm 13. The capacitance of the capacitor changes as the diaphragm 13 vibrates in accordance with the sound entering through the holes 22. The change in capacitance is output as a sound signal.

In the unit casing 11, an insulating base 16 that serves as a fixed electrode supporting member is disposed on the rear side of the fixed electrode 15. The insulating base 16 is formed of, for example, synthetic resin, and has a circular recessed portion on the front side (upper side as viewed in FIG. 6). The fixed electrode 15 is fitted in the recessed portion. A ring-shaped, further recessed portion is formed on an inner peripheral portion of the recessed portion. A ring-shaped, second sound resistance material 17 and an elastic acoustic resistance material 18 are fitted in the ring-shaped recessed portion. The insulating base 16 is provided with a hole extending in the thickness direction in the central portion. A terminal member 19 electrically connected to a field-effect transistor (FET) (not illustrated) that forms an impedance converter is fitted in the hole.

In the conventional capacitor microphone unit 1 as illustrated in FIGS. 6 and 7, an air layer that is the space between the fixed electrode 15 and the diaphragm 13 provides an acoustic resistance for controlling the vibration of the diaphragm 13. The acoustic resistance is adjusted by adjusting the number and the size of holes B penetrating through the fixed electrode 15 and the size of the space formed between the diaphragm 13 and the fixed electrode 15, for example.

However, in the case where the fixed electrode 15 is press molded for example, the size and the number of holes B cannot be readily changed.

The freedom of adjusting the acoustic resistance, by adjusting the space between the fixed electrode 15 and the diaphragm 13 through changing the thickness of the spacer 14, is limited because the spacer 14 is often formed by a commercially available plastic film and thus the choice of material is limited.

SUMMARY OF THE INVENTION

The present invention is provided in view of the above problems and an object of the present invention is to provide a capacitor microphone unit and a capacitor microphone of which acoustic resistance can be readily controlled by forming a skin layer provided on a surface of an acoustic resistance material formed of, for example, a sponge and adjusting the skin layer.

A capacitor microphone unit according to an aspect of the present invention includes a diaphragm, a fixed electrode that is arranged opposite to the diaphragm with a space provided between the diaphragm and the fixed electrode so that a capacitor is formed between the diaphragm and the fixed electrode, an insulating base that is disposed on a rear side of the fixed electrode and supports the fixed electrode, and a ring-shaped acoustic resistance material that is disposed on a front side of the insulating base, all of which are incorporated in a unit casing. A skin layer is formed on at least one of a front side and a rear side of the acoustic resistance material. The skin layer has a higher density than that inside the acoustic resistance material.

A capacitor microphone according to another aspect of the present invention includes the above-described capacitor microphone unit.

DETAILED DESCRIPTION OF THE PREFERRED EMBODIMENTS

Figure 1:
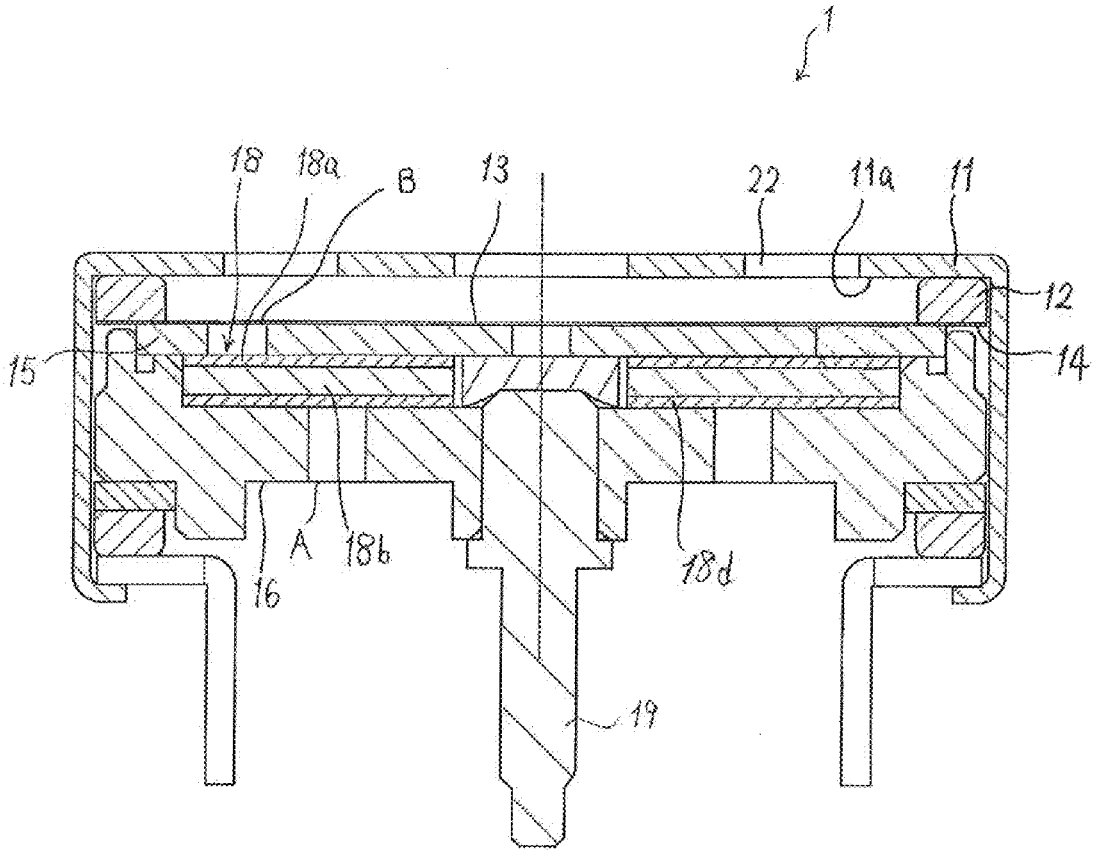
FIG. 1 is a cross-sectional view of an embodiment of a capacitor microphone unit according to the present invention.

Embodiments of a capacitor microphone unit and an embodiment of a capacitor microphone according to the present invention are described with reference to some of the accompanying drawings. Elements similar to those in the above-described conventional microphone unit are given the same reference numerals.

Capacitor Microphone Unit

Figure 2:
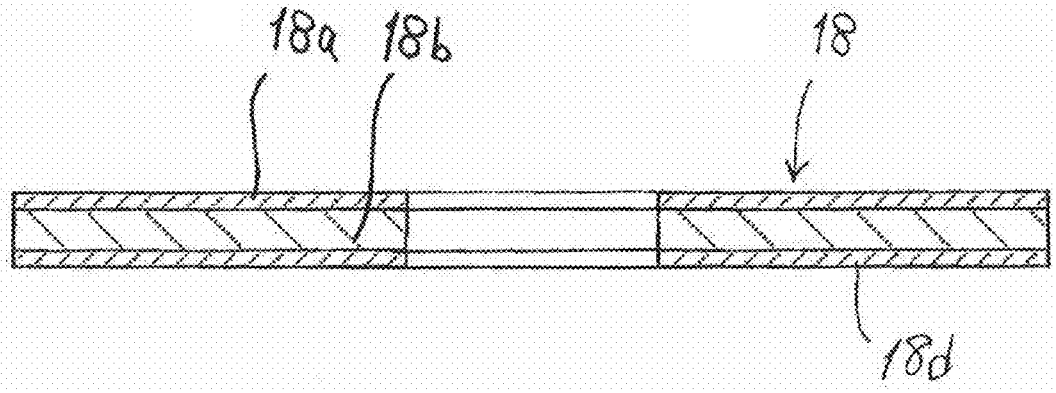
FIG. 2 is a cross-sectional enlarged view of an acoustic resistance material used in the capacitor microphone unit illustrated in FIG. 1.

A capacitor microphone unit according to an embodiment illustrated in FIGS. 1 and 2 is different from the conventional capacitor microphone unit only in the structure of an acoustic resistance material.

Figure 6:
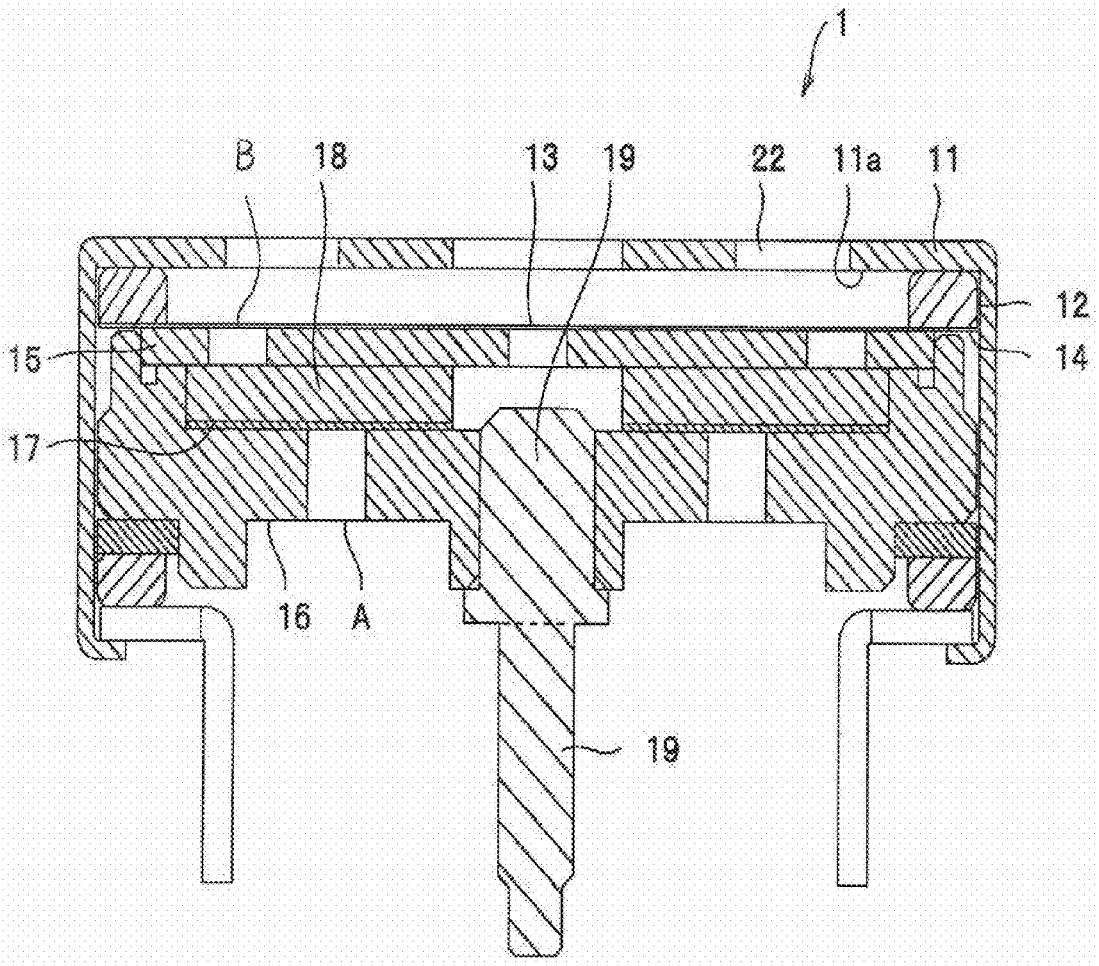
RELATED ART FIG. 6
FIG. 6 is a cross-sectional view of an example of a conventional capacitor microphone unit.
Figure 7:
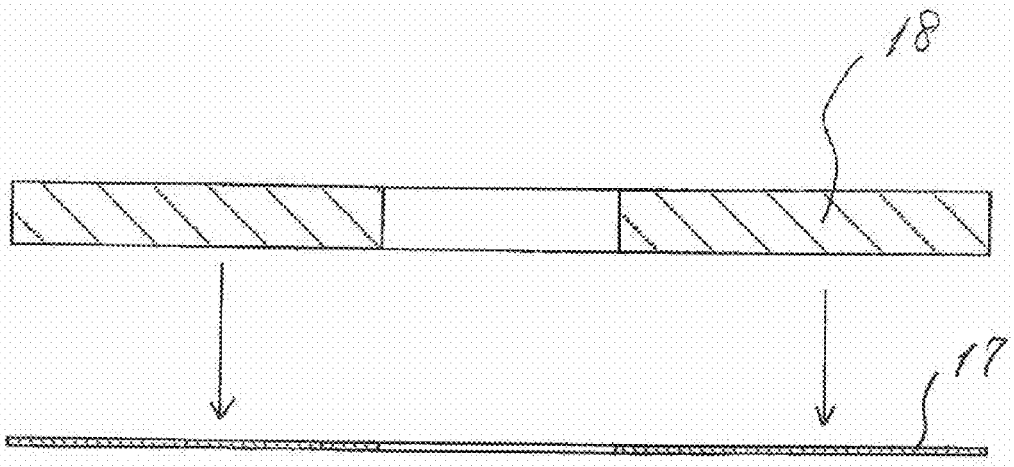
RELATED ART FIG. 7
FIG. 7 is a cross-sectional enlarged view of an acoustic resistance material and a second acoustic resistance material used in the capacitor microphone unit illustrated in FIG. 6, the acoustic resistance material and the second acoustic resistance material being illustrated in a separated state.

Similar to the conventional capacitor microphone unit as illustrated in FIG. 6, in this capacitor microphone unit 1 illustrated in FIG. 1, sound waves entering from a rear acoustic terminal A pass through an air chamber provided with an acoustic resistance material 18 to be applied to the rear side of a diaphragm. Thus, the capacitor microphone unit 1 has unidirectionality.

The capacitor microphone unit 1 is formed by installing the elements described below inside a unit casing 11 having a cylindrical shape. A side on which a bottom 11*a* is provided is the front side of the unit casing 11. The bottom 11*a* is provided with multiple holes 22 through which sound is guided inside the capacitor microphone unit 1. A ring-shaped diaphragm holder 12 and a diaphragm 13 having the peripheral portion attached to one end surface of the diaphragm holder 12 are disposed at the portion closest to the bottom 11*a* in the unit casing 11.

A fixed electrode 15 is arranged opposite to the diaphragm 13 with a ring-shaped spacer 14 provided therebetween. Thus, a space defined by the thickness of the spacer 14 is provided between the fixed electrode 15 and the diaphragm 13. Thus, a capacitor is formed by the fixed electrode 15 and the diaphragm 13. The capacitance of the capacitor changes as the diaphragm 13 vibrates in accordance with sound entering through the holes 22. The capacitance change is output as a sound signal.

In the unit casing 11, an insulating base 16 that serves as a fixed electrode supporting member is disposed on the rear side of the fixed electrode 15. The insulating base 16 is formed of, for example, synthetic resin, and has a circular recessed portion on the front side (upper side as viewed in FIG. 1). The fixed electrode 15 is fitted in the recessed portion. A ring-shaped, further recessed portion is formed on an inner peripheral portion of the recessed portion. An elastic and ring-shaped acoustic resistance material 18 is fitted in the ring-shaped recessed portion. The insulating base 16 is provided with a hole extending in the thickness direction in the central portion. A terminal member 19 electrically connected to a FET (not illustrated) that forms an impedance converter is fitted in the hole.

The acoustic resistance material 18 in the capacitor microphone unit 1 according to the present embodiment is formed of a sponge. More specifically, the acoustic resistance material 18 is formed of a sponge made of porous urethane resin material. Skin layers 18*a* and 18*d* of high density are respectively formed on the front and the rear surfaces of the acoustic resistance material 18 formed of a sponge. A low density layer 18*b* that has lower density than that of the skin layers 18*a* and 18*d* is formed on the inner side of the skin layers 18*a* and 18*d*.

The skin layers 18*a* and 18*d* are formed by heating the surfaces of a sponge material 18*c* (see FIG. 5A) according to a method of manufacturing an acoustic resistance material as described later. The acoustic resistance of the acoustic resistance material 18 can be increased by forming the skin layers 18*a* and 18*d* of higher density. The damping of the diaphragm 13 can be controlled with the skin layer 18*a*, which is in contact with the fixed electrode 15, adjusting the air flow in the air chamber on the rear side of the diaphragm 13. Directionality of the capacitor microphone unit 1 is adjusted with the skin layer 18*d*, which is in contact with the insulating base 16, providing an acoustic resistance to the rear acoustic terminal A.

The low density layer 18*b*, a portion of the sponge material 18*c*, is not thermally modified by the heat applied for manufacturing the acoustic resistance material 18. In other words, a portion of the sponge material 18*c* with no change in density is the low density layer 18*b*. The low density layer 18*b*, which has a low density, serves as an air chamber in the capacitor microphone unit 1.

The acoustic resistance of the above-described capacitor microphone unit 1 according to the present embodiment can be readily adjusted as desired by appropriately changing the thickness and the density of the skin layers 18*a* and 18*d* of the acoustic resistance material 18.

Figure 3:
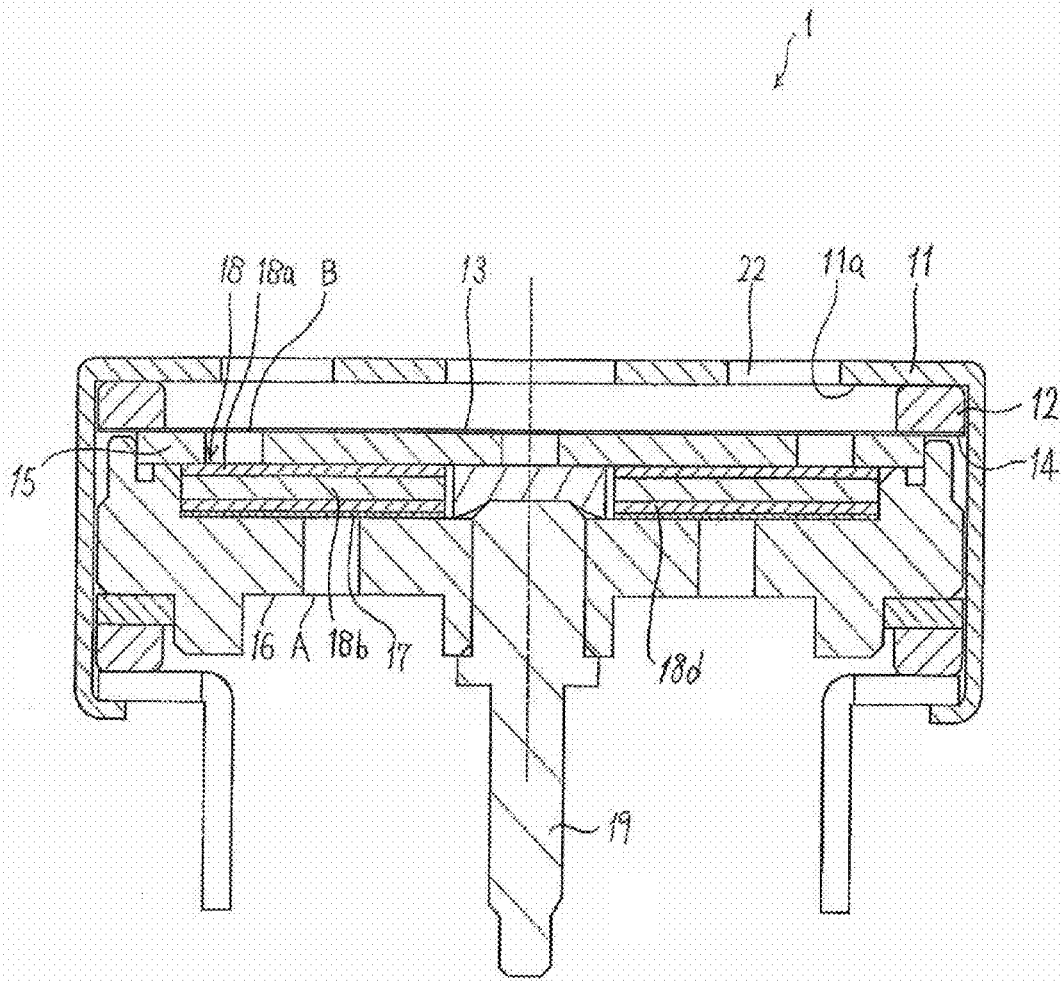
FIG. 3 is a cross-sectional view of another embodiment of a capacitor microphone unit according to the present invention.
Figure 4:
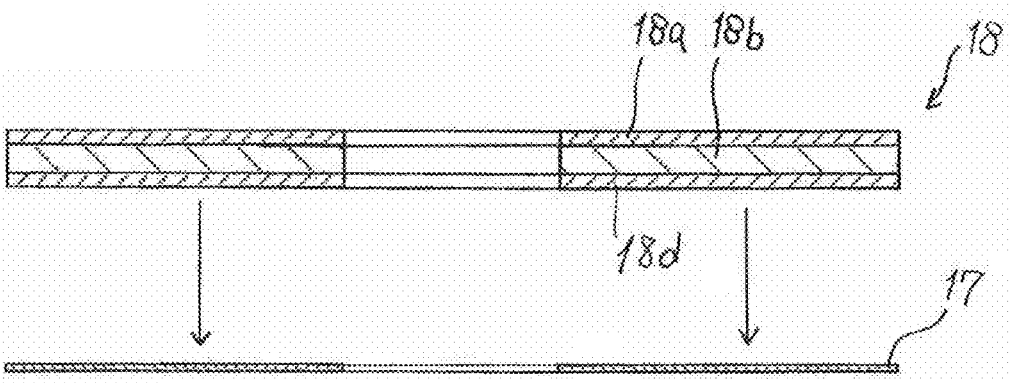
FIG. 4 is a cross-sectional enlarged view of an acoustic resistance material and a second acoustic resistance material used in the capacitor microphone unit illustrated in FIG. 3, the acoustic resistance material and the second acoustic resistance material being illustrated in a separated state.

A capacitor microphone unit according to another embodiment of the present invention is described with reference to FIGS. 3 and 4. The capacitor microphone unit according to this embodiment is different from the capacitor microphone unit of the previously described embodiment in the structure of an acoustic resistance material. Thus, the structure of the acoustic resistance material is mainly described below.

This capacitor microphone unit 1 according to this embodiment is a unidirectional capacitor microphone unit and an acoustic resistance material 18 is formed of a sponge as in the previously described embodiment. Skin layers 18*a* and 18*d* of high density are respectively formed on the front and the rear surfaces of the acoustic resistance material 18 formed of a sponge. A low density layer 18*b* that has lower density than that of the skin layers 18*a* and 18*d* is formed on the inner side of the skin layers 18*a* and 18*d*.

A nylon mesh serving as a second acoustic resistance material 17 is attached to the insulating base 16 side surface of the acoustic resistance material 18. The second acoustic resistance material 17 has a planer shape same as that of the acoustic resistance material 18.

The acoustic resistance of the above-described capacitor microphone unit 1 according to the present embodiment can be readily adjusted as desired by appropriately changing the thickness and the density of the skin layers 18*a* and 18*d* of the acoustic resistance material 18. In addition, the acoustic resistance material 18 can be more strongly pressed towards the opening of the rear acoustic terminal A of the insulating base 16, due to the elastic force of the second acoustic resistance material 17 applied in the thickness direction. Thus, acoustic resistance can be provided more stably.

In the above-described two embodiments, the two skin layers 18*a* and 18*d* are respectively formed on the front and the rear surfaces of the acoustic resistance material 18. The present invention is not limited thereto, and only one of the skin layers 18*a* and 18*d* may be formed. If the skin layer 18*a* is formed on the fixed electrode 15 side surface, the skin layer 18*a* provides acoustic resistance and the damping of the diaphragm 13 can be adjusted as in the above-described embodiments. If the skin layer 18*d* is formed on the insulating base 16 side surface, the skin layer 18*d* provides acoustic resistance and the directionality of the capacitor microphone unit 1 can be adjusted by adjusting the acoustic resistance as in the above-described embodiments.

Method for Manufacturing Acoustic Resistor

A method for manufacturing a sponge serving as the acoustic resistance material 18 in the above-described embodiments is described with reference to FIGS. 5A to 5D.

Figure 5A:
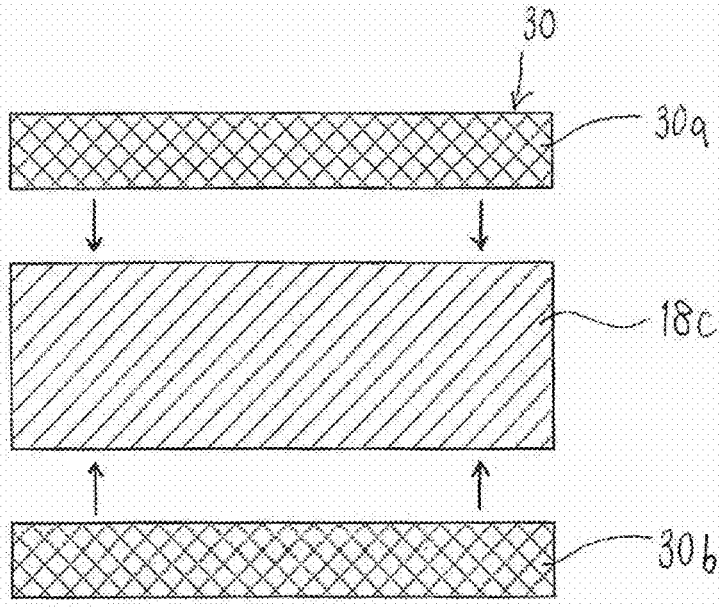
FIGS. 5A to 5D are cross-sectional views sequentially illustrating a manufacturing process of the acoustic resistance material illustrated in FIG. 2.

First, the sponge material 18*c*, which is the material of the acoustic resistance material 18, made of porous urethane resin material is provided in a pressing apparatus 30 as illustrated in FIG. 5A. The pressing apparatus 30 is an apparatus for pressing and heating the sponge material 18*c* sandwiched therein to melt the surfaces of the sponge material 18*c*, thereby forming the skin layers 18*a* and 18*d*.

Figure 5B:
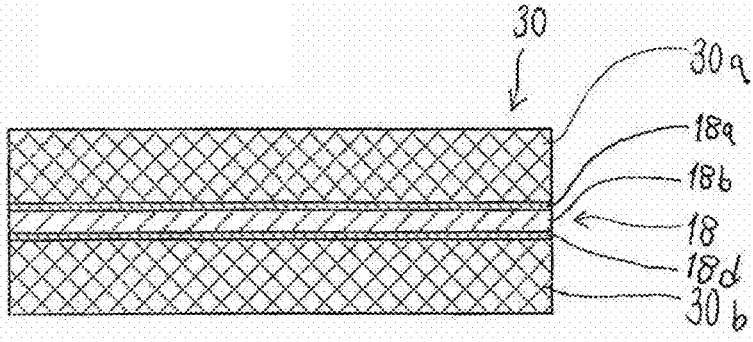

Next, as illustrated in FIG. 5B, the sponge material 18*c* is pressed and heated by the pressing apparatus 30. Thus, the surfaces of the sponge material 18*c* that come in contact with the pressing apparatus 30 are melted and the skin layers 18*a* and 18*d* are formed. The thickness and the density of the skin layers 18*a* and 18*d* to be formed can be adjusted as required by appropriately setting the pressing force, heating temperature, and heating and pressing time of an upper mold 30*a* and a lower mold 30*b* of the pressing apparatus 30. Thus, the acoustic resistance of the acoustic resistance material 18 can be adjusted as desired. The lower density layer 18*b* is an inner portion of the sponge material 18*c* that remains unmelted.

Figure 5C:
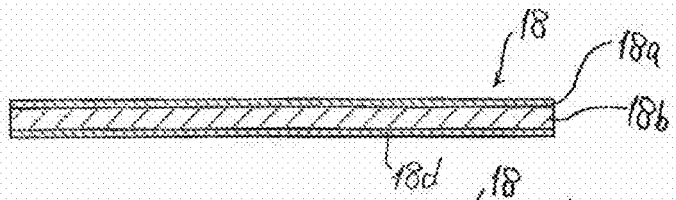

Then, as illustrated in FIG. 5C, the acoustic resistance material 18 on which the skin layers 18*a* and 18*d* are formed is taken out from the pressing apparatus 30.

Figure 5D:
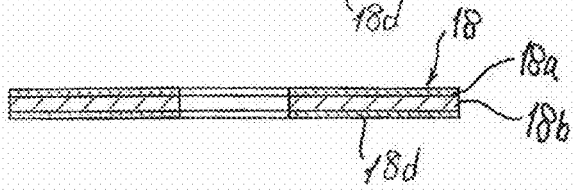

Finally, as illustrated in FIG. 5D, the acoustic resistance material 18 is taken out of the pressing apparatus 30 and is provided with the center hole by drilling and its outer peripheral portion is cutoff so as to have a ring shape so that it can incorporated in the unit casing 11.

Capacitor Microphone

A capacitor microphone according to an embodiment of the present invention is formed by incorporating the capacitor microphone unit described in any of the above-described embodiments in a microphone casing. If required, the microphone casing may be provided with a connector to which a microphone cable is connected.

The acoustic resistance of the capacitor microphone according to the present embodiment can be readily controlled by forming a skin layer on a surface of the acoustic resistance material formed of a sponge and adjusting the density and the thickness of the skin layer.

In the above-described embodiments, the acoustic resistance material 18 is formed of a sponge made of porous urethane resin material. The present invention is not limited thereto and various modifications can be made.

For example, other porous resin material can be used instead of the porous urethane resin material. Alternatively, a nonwoven cloth made of resin can be used instead of a porous material.

Furthermore, the second acoustic resistance material 17 in the above-described second embodiment can be nonwoven cloth made of cotton or resin instead of the nylon mesh.

What is claimed is:

1. A capacitor microphone unit comprising:

a diaphragm;

a fixed electrode that is arranged opposite to the diaphragm with a space provided between the diaphragm and the fixed electrode so that a capacitor is formed between the diaphragm and the fixed electrode;

an insulating base that is disposed on a rear side of the fixed electrode and supports the fixed electrode on a front side of said insulating base;

a ring-shaped acoustic resistance material that is disposed on said front side of the insulating base; and a second acoustic resistance material positioned on said front side of said insulating base between said ring-shaped acoustic resistance material and said insulating base, wherein all of the diaphragm, the fixed electrode, the insulating base, the acoustic resistance material and the second acoustic resistance material are incorporated in a unit casing, and a skin layer is formed on at least one of a front side and a rear side of the acoustic resistance material, and the skin layer has a higher density than that inside the acoustic resistance material.

2. The capacitor microphone unit according to claim 1, wherein the skin layer is formed on both the front side and the rear side of the acoustic resistance material.

3. The capacitor microphone unit according to claim 1, wherein the skin layer is formed on at least the front side of the acoustic resistance material and the skin layer is in contact with the fixed electrode.

4. The capacitor microphone unit according to claim 1, wherein the skin layer is formed on at least the rear side of the acoustic resistance material and is in contact with the second acoustic resistance material.

5. The capacitor microphone unit according to claim 1, wherein the acoustic resistance material is a sponge sheet.

6. The capacitor microphone unit according to claim 1, wherein the skin layer is at least formed on the rear side of the acoustic resistance material.

7. The capacitor microphone unit according to claim 6, wherein the second acoustic resistance material is a nylon mesh.

8. The capacitor microphone unit according to claim 6, wherein the second acoustic resistance material is nonwoven cloth.

9. A capacitor microphone comprising: the capacitor microphone unit according to claim 1.

* * * * *